US010323309B2

(12) United States Patent
Anderseck et al.

(10) Patent No.: US 10,323,309 B2
(45) Date of Patent: Jun. 18, 2019

(54) METHOD AND DEVICE FOR PROCESSING EXTRUDED PROFILE SEGMENTS COMPOSED OF MAGNESIUM OR MAGNESIUM ALLOYS AND A LIGHTWEIGHT CONSTRUCTION ELEMENT PRODUCED THEREFROM

(71) Applicant: Ulrich Bruhnke, Ehningen (DE)

(72) Inventors: Ralf Anderseck, Grafendorf (DE); Andreas Jaeger, Dortmund (DE); Karl-Heinz Lindner, Muelheim (DE)

( * ) Notice: Subject to any disclaimer, the term of this patent is extended or adjusted under 35 U.S.C. 154(b) by 46 days.

(21) Appl. No.: 15/129,078

(22) PCT Filed: Feb. 13, 2015

(86) PCT No.: PCT/DE2015/000070
§ 371 (c)(1),
(2) Date: Sep. 26, 2016

(87) PCT Pub. No.: WO2015/144113
PCT Pub. Date: Oct. 1, 2015

(65) Prior Publication Data

US 2017/0107601 A1 Apr. 20, 2017

(30) Foreign Application Priority Data

Mar. 26, 2014 (DE) ..... 10 2014 004 329

(51) Int. Cl.
*C22F 1/06* (2006.01)
*B21C 35/03* (2006.01)
(Continued)

(52) U.S. Cl.
CPC ..... *C22F 1/06* (2013.01); *B21C 23/002* (2013.01); *B21C 35/023* (2013.01);
(Continued)

(58) Field of Classification Search
None
See application file for complete search history.

(56) References Cited

U.S. PATENT DOCUMENTS 4,077,247 A * 3/1978 Stewart ..... B21D 13/10 29/896.6
5,996,456 A 12/1999 Streck
(Continued)

FOREIGN PATENT DOCUMENTS

DE 2105537 C3 1/1979
DE 19725300 C2 4/2001
(Continued)

OTHER PUBLICATIONS

Translation of DE 10150021 A (Published May 2003) from Espacenet.*
(Continued)

*Primary Examiner* — George Wyszomierski
(74) *Attorney, Agent, or Firm* — Smartpat PLC

(57) ABSTRACT

The invention for working extruded profile sections with respect to the outer contours thereof by way of hot shaping and/or hot stamping and/or cutting operations and/or punching operations comprises the following method steps: —inserting the profile sections (1) heated to a temperature in the range of 250 to 450° C. into a two-part shaping tool (2) preheated to a temperature of 300 to 600° C.; and —applying pressure to the shaping tool (2) by way of one or more pressing cylinders (3) of a press (4). The device for carrying out the method comprises a press (4) and a shaping tool, wherein the shaping tool (2) is formed of two tool halves I, II, which are displaceable with respect to each other, and between which the profile section (1) is inserted.

8 Claims, 1 Drawing Sheet

(51) Int. Cl.

| | |
|---|---|
| ***B21D 22/02*** | (2006.01) |
| ***B21J 1/06*** | (2006.01) |
| ***B21J 5/02*** | (2006.01) |
| ***B21J 15/00*** | (2006.01) |
| ***B21C 35/02*** | (2006.01) |
| ***B21C 23/00*** | (2006.01) |

(52) U.S. Cl.
CPC ..... *B21D 22/022* (2013.01); *B21J 1/06* (2013.01); *B21J 5/02* (2013.01); *B21J 15/00* (2013.01)

(56) References Cited

U.S. PATENT DOCUMENTS

| | | | | |
|---|---|---|---|---|
| 2004/0221452 | A1* | 11/2004 | Wirth | B21K 1/18 29/888.04 |
| 2005/0016108 | A1 | 1/2005 | Lindner et al. | |
| 2006/0075799 | A1* | 4/2006 | Schroth | B21D 37/16 72/342.8 |
| 2006/0078799 | A1* | 4/2006 | Watanabe | C01G 31/00 429/245 |
| 2010/0269346 | A1* | 10/2010 | Wolf | B21D 26/033 29/894.322 |
| 2012/0312064 | A1* | 12/2012 | Tatarczyk | B21D 28/16 72/336 |
| 2013/0186165 | A1* | 7/2013 | Flehmig | B21D 22/00 72/343 |
| 2013/0218292 | A1* | 8/2013 | Bayer | C10M 103/04 623/23.64 |

FOREIGN PATENT DOCUMENTS

| | | | |
|---|---|---|---|
| DE | 101 50 021 | A1 | 5/2003 |
| DE | 10224198 | C1 | 8/2003 |
| DE | 10 2008 045 441 | B3 | 2/2010 |
| JP | 2000-246386 | A | 9/2000 |
| JP | 2002-273540 | A | 9/2002 |

OTHER PUBLICATIONS

Translation of JP 2000-246386 (published Sep. 2000) from J-Plat Pat.*

Translation of JP 2002-273540 (published Sep. 2002) from J-Plat Pat.*

Tsai, H-K. et al., "Die Design for Stamping a Notebook Case with Magnesium Alloy Sheets", J. of Materials Processing Technology, vol. 201, pp. 247-251, 2008.*

* cited by examiner

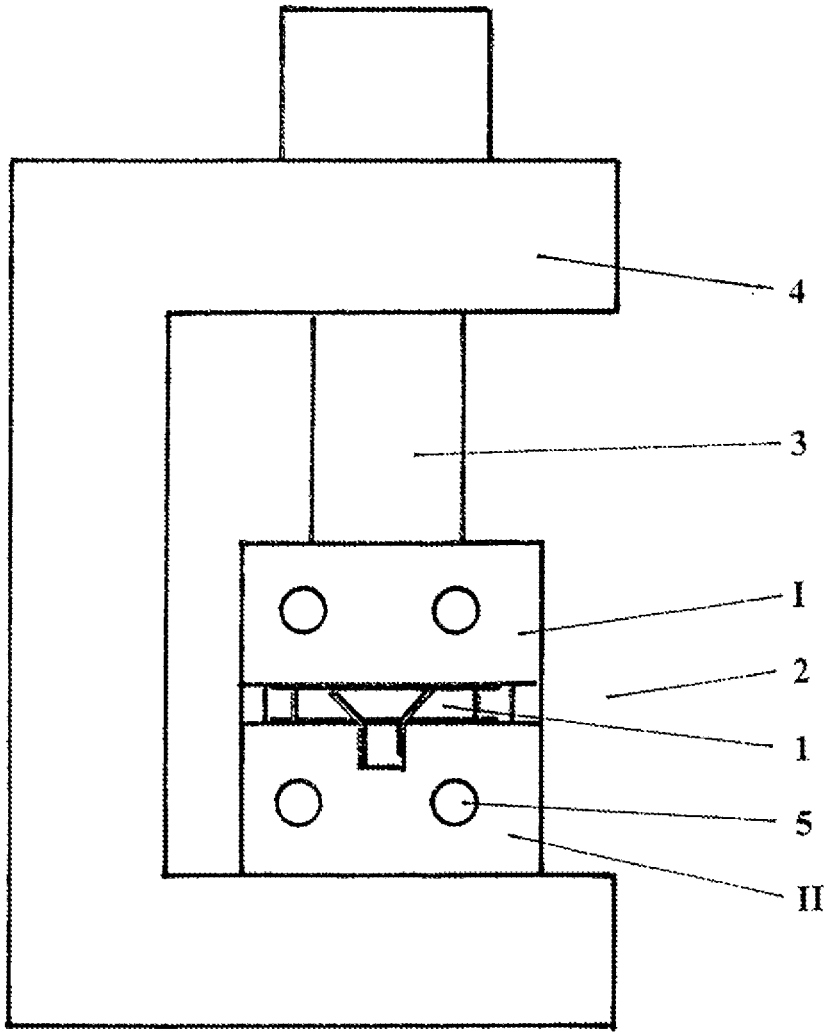
4
3
I
2
1
5
II

METHOD AND DEVICE FOR PROCESSING EXTRUDED PROFILE SEGMENTS COMPOSED OF MAGNESIUM OR MAGNESIUM ALLOYS AND A LIGHTWEIGHT CONSTRUCTION ELEMENT PRODUCED THEREFROM

The invention relates to a method and to a device for working extruded profile sections made of magnesium or magnesium alloys with respect to the outer contours thereof by way of hot shaping and/or hot stamping and/or cutting operations and/or punching operations for the subsequent joining processes.

In particular, the invention relates to extruded hollow chamber profiles, which are subsequently to be joined to form assemblies (lightweight construction element).

A method for producing an extruded profile section from a hardenable aluminum alloy is known from DE 10 2008 045 441 B3, in which, after the profile has been pressed and the profile sections have been cut to size, an internal pressure forming step for shaping the outer contour of a profile section is carried out when the profile section is in the solution-annealed state thereof, or in a solution annealed-like state, wherein the internal pressure forming step for shaping the outer contour of the profile section is carried out after the profile section has been cooled to the ambient temperature, before more than 20% of the cold hardening process has been completed.

A tool for hot shaping and hot punching workpieces is known from DE 19725300 C2, which allows corresponding workpieces to be shaped and punched quickly and easily. For this purpose, the workpiece is placed onto the receiving tool in correct positional arrangement. For the shaping process, the shaping tool is moved in the direction of the receiving tool and pressed against this, wherein the hot shaping is carried out by the wall parts surrounding the tool on the outside and the part extending between the wall parts. Shaping is not carried out to the finished dimensions, but the corresponding workpieces are subsequently machined and finished to the final dimensions.

DE 2 105 537 C3 describes a device for hot shaping rod-shaped goods to be rolled during hot rolling in the production flow of a continuous rolling train, in which a die is disposed downstream of the finishing roll stand, and the rod-shaped goods to be rolled and hot-shaped are pushed through the die by the rolls of the finishing roll stand, wherein the die is designed as a closed ring die, and the ring die, which can be heated to the rolling temperature, is made of a high temperature resistant material, and, upstream of the ring die, a nozzle ring having an opening for adding thermally stable lubricants, such as colloidal graphite, glass having a low melting point, soda, burnt lime or salts is disposed, and, upstream of the nozzle ring, two labyrinth ring chambers are disposed, and the ring die is spring-cushioned axially in both directions.

A lightweight construction element and a production method are known from DE 10224198C1, in which the lightweight construction element comprises multiple extruded hollow sections that are joined to each other in a planar arrangement. The associated method comprises the following steps: a) extruding hollow sections having a wall thickness of no more than 0.5% of the diameter of the circumscribed circle of the lightweight construction element produced therefrom; and b) joining multiple hollow sections in a planar arrangement to form a lightweight construction element, which has a circumscribed circle of at least 300 mm. The hollow sections are joined by way of friction welding or adhesive bonding.

Extruded profiles, and in particular multi-chamber extruded profiles, become warped upon exiting the die of the extrusion press. This causes problems, especially during a subsequent joining process, in which planar assemblies are to be assembled from the extruded profile sections.

One of the greatest challenges today in the construction of vehicles, in particular automobiles, lies in minimizing the weight as one of the most effective options for saving fuel.

A cost-benefit comparison of various lightweight metals shows that ever progressing weight savings are driving up manufacturing costs. This means that lightweight construction can only be economically implemented if it is possible to lower the associated manufacturing costs through higher productivity, and especially by using materials sparingly.

Compared to steel materials, which are used predominantly today, lightweight metals have the advantage that these have a considerably lower density. The lightest of these metals is magnesium, which is approximately 35% lighter than aluminum. The current new magnesium alloys exhibit very good properties, such as corrosion resistance and good deformation properties, allowing these to be used for extrusion.

One drawback with extrusion is that the size of the extruded profiles that can be produced is limited, requiring assemblies to be joined from individual extruded profile sections.

It is the object of the invention to provide a method and a device for working extruded profile sections made of magnesium or magnesium alloys which eliminate the above-described drawbacks.

A further object is to create a lightweight construction element produced therefrom, which is produced from individual extruded profile sections by way of joining, whereby a practically arbitrarily sized lightweight construction element can be achieved.

According to the invention, this object is achieved by using the method to bring the extruded profile sections made of magnesium or magnesium alloys to a dimensional accuracy with respect to the outer contours thereof for the subsequent joining process by way of hot shaping, so as to simplify the joining process. At the same time, it is possible to carry out stamping operations, cutting operations and/or punching operations, together with the hot shaping process. Hot shaping is preferably carried out in the production flow subsequent to the extrusion process. This has the advantage that the profile exiting the die already has a temperature in the range of 250 to 450° C. and does not require additional heating.

Compared to shaping according to the internal high pressure forming method, this is considerably more effective and, given the extremely high costs of hydroforming tools, considerably more cost-efficient.

The profile sections thus shaped can be joined to form lightweight construction elements without great complexity. In vehicle construction, such lightweight construction elements can be supporting structures in the form of floor pans, for example.

The invention will be described in more detail based on one exemplary embodiment.

The associated FIG. 1 shows a device for carrying out the method for hot shaping extruded profile sections.

The method according to the invention comprises the following steps:—inserting the profile sections 1 heated to a temperature in the range of 250 to 450° C. into a two-part shaping tool 2 preheated to a temperature in the range of 300 to 600° C.; and—applying pressure to the shaping tool 2 by way of one or more pressing cylinders 3 of a press 4. In addition, insertion elements may be inserted into the end faces of the profile sections 1 that have been cut to size, if needed.

The insertion elements can comprise pin-like projections, the cross-sections of which are adapted to the inner cross-sections of the profile sections 1.

It is advantageous if the method steps for hot shaping take place subsequent to the extrusion process, since heating of the extruded profile section can then be dispensed with.

FIG. 1 shows a representative illustration of the device for carrying out the method. The device essentially comprises a press 4 and a shaping tool 2. The shaping tool 2 has a two-part design and accordingly comprises two tool halves I, II, which can be displaced with respect to each other and between which the profile section 1 is inserted, wherein the tool halves are adapted to the cross-section of the profile to be shaped.

By applying pressure to at least one of the two tool halves I, II via a pressing cylinder 3 of the press 4, the tool halves are displaced toward each other, and the profile section is shaped, which is to say the profile sections are brought to uniform dimensions, while being straightened.

The tool halves I, II have boreholes, into which corresponding heating cartridges are inserted to heat the tool halves I, II or maintain these at the temperature.

If needed, one or more stamping dies can be disposed in one or both tool halves I, II, with the aid of which surface stamping of the profile sections on one side, or on both sides, can be carried out simultaneously during the shaping process.

Another option is to integrate cutting or punching tools into the tool halves I, II so as to simultaneously carry out cutting or punching operations in the profile sections 1 during the shaping process.

Subsequent to the hot shaping process, the shaped and/or stamped and/or punched profile sections can be joined to form a lightweight construction element.

The lightweight construction element can be designed, for example, as a supporting structure for a land vehicle, an aircraft or a watercraft, and the individual hot-shaped profile sections 1 of which, that form the lightweight construction element, are joined to each other by way of a non-detachable connection. This can preferably take place by way of friction stir welding, whereby shorter welding times and high economic efficiency are achieved during the joining process.

LIST OF THE REFERENCE NUMERALS

1 profile sections
2 shaping tool
3 pressing cylinder
4 press
5 boreholes
I tool half
II tool half

The invention claimed is:

1. A device for straightening warped extruded profile sections made of magnesium or magnesium alloys, comprising a press which applies pressure to a shaping tool, the shaping tool being formed of two tool halves which can be displaced with respect to each other, and insertion elements which are inserted into end faces of a warped extruded hollow profile section, the insertion elements having pin-like projections with cross-sections which are adapted to an inner cross-section of the warped extruded hollow profile section, wherein the shaping tool receives the warped extruded hollow profile section and forms a straightened extruded hollow profile section by displacing the two tool halves towards each other.

2. The device according to claim 1, wherein at least one of the tool halves is shaped to match a cross-section of the straightened extruded hollow profile section.

3. The device according to claim 1, wherein stamping dies are disposed in at least one of the tool halves facing the profile section.

4. The device according to claim 1, wherein boreholes for receiving heating cartridges are provided in the tool halves of the shaping tool.

5. The device according to claim 1, wherein a gap is formed within the shaping tool when the two tool halves are pushed against each other, the gap defining outer contours of the straightened extruded profile section.

6. A method for working extruded profile sections made of magnesium or magnesium alloys with respect to outer contours thereof by way of hot shaping and/or hot stamping and/or cutting operations and/or punching operations, comprising the following method steps:

providing the device as in claim 1;

inserting profile sections which have been heated to a temperature between 250 and 450° C. into the shaping tool which has been preheated to a temperature between 300 and 600° C.; and applying pressure to the shaping tool by way of one or more pressing cylinders of the press.

7. The method according to claim 6, further comprising:

cutting the profile sections to length, and inserting insertion elements into end faces of the profile sections that have been cut to length.

8. The method according to claim 6, wherein the method steps are carried out in a production flow subsequent to an extrusion process.

* * * * *